United States Patent [19]

Alexandrovich et al.

[11] Patent Number: 5,051,330

[45] Date of Patent: Sep. 24, 1991

[54] FLUORINATED ONIUM SALTS AS TONER ELECTROSTATIC TRANSFER AGENTS AND CHARGE CONTROL AGENTS

[75] Inventors: Peter S. Alexandrovich; Douglas E. Bugner; Lawrence P. DeMejo, all of Rochester, N.Y.

[73] Assignee: Eastman Kodak Company, Rochester, N.Y.

[21] Appl. No.: 450,960

[22] Filed: Dec. 15, 1989

[51] Int. Cl.[5] ..... G03G 9/0979

[52] U.S. Cl. ..... 430/110; 430/126; 430/197

[58] Field of Search ..... 430/110, 126; 427/197

[56] References Cited

U.S. PATENT DOCUMENTS

| | | | |
|---|---|---|---|
| 3,893,935 | 7/1975 | Jadwin | 252/62.1 |
| 3,948,654 | 4/1976 | Fisher | 252/62.1 |
| 4,139,483 | 2/1979 | Williams | 252/62.1 |
| 4,198,477 | 4/1980 | Williams | 430/120 |
| 4,454,214 | 6/1984 | Gruber | 430/110 |
| 4,468,446 | 8/1984 | Mikami et al. | 430/138 |
| 4,496,643 | 1/1985 | Wilson | 430/110 |
| 4,537,848 | 8/1985 | Yourd | 430/110 |
| 4,684,596 | 8/1987 | Bonser | 430/110 |
| 4,812,381 | 3/1989 | Bugner | 430/110 |

*Primary Examiner*—John Goodrow

*Attorney, Agent, or Firm*—Dressler, Goldsmith, Shore, Sutker & Milnamow, Ltd.

[57] ABSTRACT

A process is provided for increasing the electrostatic transfer efficiency of toner powder from an element to a receiver sheet. The method involves conducting such transfer in the presence of at least one fluorinated onium salt wherein either one or both of the cationic portion and the anionic portion thereof contain a fluorinated hydrocarbon group. Further included are novel toner powders, a novel coated element, and certain new fluorinated onium salt compounds.

11 Claims, No Drawings

FLUORINATED ONIUM SALTS AS TONER ELECTROSTATIC TRANSFER AGENTS AND CHARGE CONTROL AGENTS

FIELD OF THE INVENTION

This invention is in the field of electrostatic toner transfer utilizing fluorinated onium salts as transfer and charge control agents.

BACKGROUND OF THE INVENTION

In electrostatic copying, an electrostatic latent image is formed on an element and is developed into a visible and transferrable image by the application of toner powder thereover. The developed toned image is commonly then transferred from the element to a receiver sheet using an electrostatic bias applied between the element and the receiver sheet. Thereafter, the toned image on the receiver sheet is heat fused and bonded thereto.

A number of useful charge-control agents and transfer agents are known, but the search continues for materials that provide improvements in toner thermal stability and fusibility without detracting from transfer efficiency or triboelectric properties.

Certain fluorinated compounds are known to the prior art for use in toner compositions such as tetrafluoroborates in U.S. Pat. No. 4,454,214; "organofluoro compounds" in U.S. Pat. No. 4,468,446; "fluorinated surfactants" of U.S. Pat. Nos. 4,198,477; and 4,139,483; "perfluoro organic acid derivatives" of U.S. Pat. No. 3,948,654; and the like. Certain onium compounds have previously been taught for use in toner compositions (see, for example, U.S. Pat. Nos. 4,812,381; 4,684,596; 3,893,935; 4,537,848; and 4,496,643).

So far as now known; however, nothing in the prior art has taught or suggested the use of fluorinated onium compounds in methods for increasing toner electrostatic transfer efficiency from an element to a receiver sheet.

SUMMARY OF THE INVENTION

This invention is directed to onium salts of the formula:

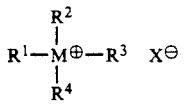

I wherein:

M is nitrogen;

$R^1$ is fluorinated and perfluorinated alkyl substituted phenyl;

$R^2$, $R^3$ and $R^4$ are each selected from the group consisting of hydrogen, alkyl of 1 through 30 carbon atoms, cycloalkyl of 3 through 30 carbon atoms, partially fluorinated and perfluorinated alkyl of 1 through 30 carbon atoms, partially fluorinated and perfluorinated cycloalkyl of 3 through 30 carbon atoms, aryl of 6 through 18 carbon atoms, and alkylaryl of the formula:

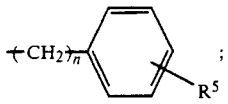

$R^5$ is selected from the group consisting of hydrogen, alkyl of 1 through 30 carbon atoms, cycloalkyl of 3 through 30 carbon atoms, partially fluorinated and perfluorinated alkyl of 1 through 30 carbon atoms, and partially fluorinated and perfluorinated cycloalkyl of 3 through 30 carbon atoms;

X is a monovalent anion selected from the group consisting of halide, carboxylate of the formula:

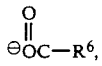

phosphate, borate, sulfate, and sulfonate of the formula:

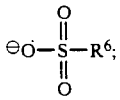

$R^6$ is selected from the group consisting of alkyl of 1 through 30 carbon atoms, cycloalkyl, cycloalkyl of 3 through 30 carbon atoms, fluorinated and perfluorinated alkyl of 1 through 30 carbon atoms, and partially fluorinated and perfluorinated cycloalkyl of 3 through 30 carbon atoms; and n is an integer of 0, 1, or 2.

This invention is also directed to a process for increasing the electrostatic transfer efficiency of toner powder from an element to a receiver sheet utilizing an onium salt of Formula II as a transfer agent and/or a charge control agent. The onium salt can be present on the surface of the element as a coating and/or in combination with the toner powder being used for imaging purposes on the element and for transfer to the receiver sheet.

The onium salt increases the transfer efficiency by eliminating or significantly reducing the occurrence of such known electrostatic toner powder transfer defects as "halo" and "hollow character." Also, the salt when incorporated with toner powders additionally produces excellent triboelectric behavior, and can be used as a charge control agent either alone or in combination with known charge control agents.

When incorporated into a toner powder, it is expected that the onium salts of Formula II will eventually coat the surface of the photoconductive element in view of the repeated contact of the toner powder with the photoconductive element. Furthermore, when the onium salts of Formula II are applied to the surface of the photoconductive element, it is expected that they will eventually be transferred to the toner powder by abrasion and thus it is important to note that the onium salts of Formula II also function as charge control agents and, therefore, will not deleteriously affect the triboelectric charge on the toner powder as has been noted with conventional transfer aids such as zinc stearate.

The fluorinated onium salts employed in the methods and photoconductors of this invention are characterized by the formula:

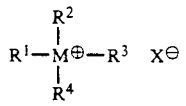

II wherein:

M is selected from the group consisting of nitrogen and phosphorous; $R^1$, $R^2$, $R^3$, and $R^4$ are each selected from the group consisting of hydrogen, alkyl of 1 through 30 carbon atoms, cycloalkyl of 3 through 30 carbon atoms, partially fluorinated and perfluorinated alkyl of 1 through 30 carbon atoms, partially fluorinated and perfluorinated cycloalkyl of 3 through 30 carbon atoms, aryl of 6 through 18 carbon atoms, and alkaryl of the formula:

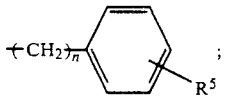

$R^5$ is selected from the group consisting of hydrogen, alkyl of 1 through 30 carbon atoms, cycloalkyl of 3 through 30 carbon atoms, partially fluorinated and perfluorinated alkyl of 1 through 30 carbon atoms, and partially fluorinated and perfluorinated cycloalkyl of 3 through 30 carbon atoms;

X is a monovalent anion selected from the group consisting of halide, carboxylates of the formula:

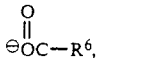

phosphate, borate, sulfate, and sulfonates of the formula:

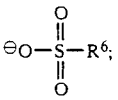

$R^6$ is selected from the group consisting of alkyl of 1 through 30 carbon atoms, cycloalkyl, cycloalkyl of 3 through 30 carbon atoms, partially fluorinated and perfluorinated alkyl of 1 through 30 carbon atoms, and partially fluorinated and perfluorinated cycloalkyl of 3 through 30 carbon atoms; and n is an integer of 0, 1, or 2; wherein two or more of $R^1$ through $R^6$ can be interconnected together to form cyclic groups and/or inner salts; provided that at least one of $R^1$ through $R^6$ is selected from the group consisting of partially fluorinated and perfluorinated alkyl of 1 through 30 carbon atoms and partially fluorinated and perfluorinated cycloalkyl of 3 through 30 carbon atoms.

The invention is also directed to new toner powders which incorporate at least one compound of Formula II.

The invention is further directed to elements coated on the imageable surface portions thereof with at least one compound of Formula II.

Other and further aims, features, advantages, and the like will be apparent to those skilled in the art when taken with the accompanying drawings and appended claims.

DETAILED DESCRIPTION OF THE INVENTION

The term "particle size", as used herein, or the term "size", or "sized" as employed herein in reference to the term "particles", means volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or "$T_g$" as used herein means the temperature at which a polymer changes from a glassy state to a rubbery state. This temperature ($T_g$) can be measured by differential thermal analysis as disclosed in "Techniques and Methods of Polymer Evaluation", Vol. 1, Marcel Dekker, Inc., N.Y. 1966.

The term "melting temperature" or "$T_m$" as used herein means the temperature at which a polymer changes from a solid state to a liquid state. This temperature ($T_m$) can be measured by differential thermal analysis as disclosed in "Techniques and Methods of Polymer Evaluation".

The term "receiver sheet" as used herein has reference to a substrate upon which a toner powder image can be formed by deposition (including transfer) and subsequent heat fusion. Examples of suitable receiver sheets include paper; plastic film, such as films of polyethylene terephthalate, polycarbonates, or the like, which are preferably transparent and therefore useful in making transparencies; and the like. The receiver sheet must not melt, soften, or lose mechanical integrity during transfer, sintering, or heat fusion of toner particles as taught herein. Preferred substrates do not readily absorb the thermoplastic polymer matrix of the toner particles when toner particles are being heat fused, so that the polymer tends to stay on the surface portions of a substrate and form a good bond thereto. Substrates having a smooth surface will tend to result in a better heat fused image quality. Paper is a presently preferred receiver sheet. In general, a flexible receiver sheet is particularly desirable, and is even necessary when the present invention is to be practiced using conventional or specially modified copying machines.

The term "transfer efficiency" as used herein in relation to electrostatic transfer and the toner powder used herein means the weight percentage of toner powder in a toned image that is transferred from an element to a receiver sheet.

The term "onium" as used herein means a cation having one more covalent bond to its central atom than is required to make a neutral molecule. The central atom is either nitrogen, in which case the cation is ammonium, or phosphorous, in which case the cation is phosphonium.

The term "triboelectric" or "triboelectric effect" as used herein means the electric charge generated by friction when two bodies of differing composition are rubbed together.

The term "halo" as used herein in relation to defects that can occur during electrostatic toner powder transfer from an element to a receiver sheet means a toned image imperfection caused by differential toner transfer efficiencies due to adjacent toner densities.

The term "hollow character" as used herein in relation to defects that can occur during electrostatic toner powder transfers from an element to a receiver sheet means an apparent, or visually observable, incomplete transfer of a center portion of an imaged area, particularly an area that is supposed to be uniformly toned.

The term "molecular weight" as used herein has reference to number average molecular weight.

Presently preferred compounds of Formula (I) are those wherein:

M is nitrogen: $R^1$ and $R^2$ are methyl; $R^3$ is methyl, butyl or hexyl; $R^4$ is

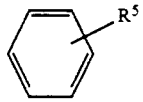

wherein $R^5$ is $R_f$ or $R_fCH_2$—where $R_f$ is $CF_3(CF_2)_n$—and n is 0–7; and X is

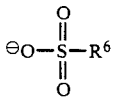

where $R^6$ is

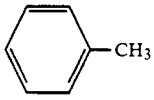

or $R_f$.

Presently preferred compounds of Formula II are those wherein M,. $R^1$, $R^2$, $R^3$, $R^4$, $R^5$, $R^6$ and X are as defined for preferred Formula I compounds and those wherein M is phosphorous, $R^1$ is methyl, $R^2$, $R^3$, and $R^4$ are

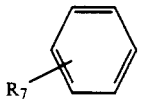

where $R^7$ is $CF_3$ and X is as defined for preferred Formula 1 compounds.

The compounds of Formula II can be prepared by various synthetic procedures as illustrated by Equations 1 through 7 below.

Equation 1

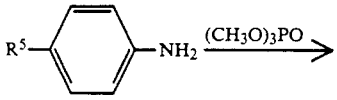

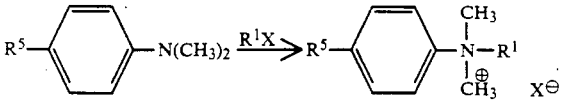

Equation 2

-continued

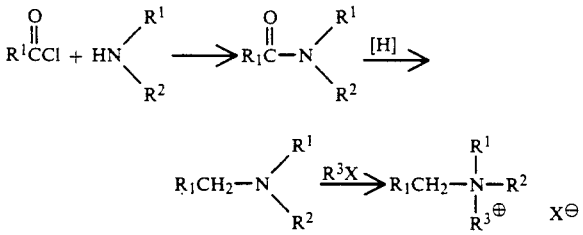

Equation 3

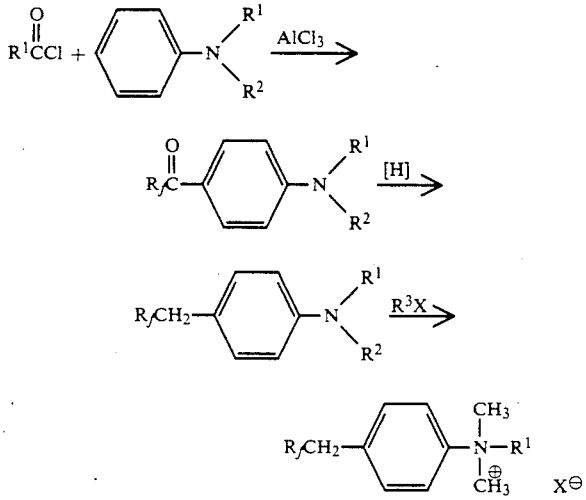

Equation 4

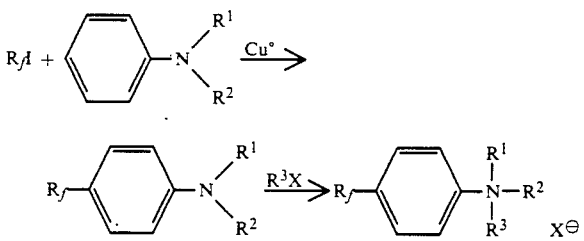

Equation 5

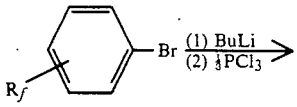

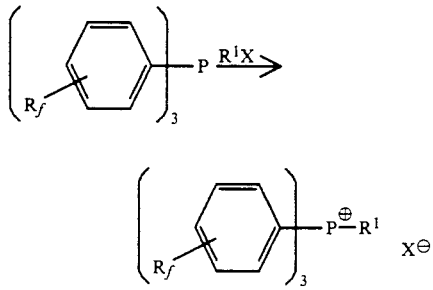

Equation 6

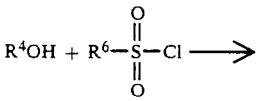

-continued

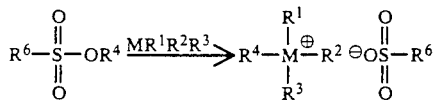

Equation 7

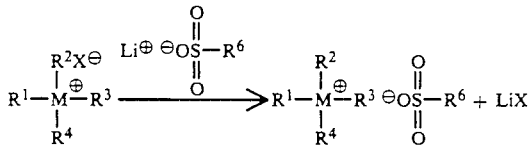

In Equations (1) through (7), $R_f$ is a perfluorinated or partially fluorinated alkyl group containing 1 through 30 carbon atoms. All other substituents are as above defined in Formula II.

The toner particles employed in the practice of this invention can have particle sizes in the range of about 3 to about 100 microns. A present preference is to employ toner particles having a particle size in the range of about 1 to about 30 microns.

In general, toner powders of the present invention comprise a thermoplastic polymer, a colorant, a compound of Formula II and, optionally, an additional charge control agent.

The thermoplastic polymer employed in toner powders has:

a glass transition temperature in the range of about 50° to about 120° C.;

a melting temperature in the range of about 65° to about 200° C.; and a molecular weight in the range of about 20,000 to about 500,000.

Examples of suitable such thermoplastic polymers includes polystyrene; copolymers of styrene and acrylic monomers; polyacrylates; polymethacrylates including poly(methylmethacrylates), and the like; polyvinyl acetate; polyesters; polyamides; polycarbonates; phenol formaldehyde resins; polyolefins including olefin copolymers such as poly(vinylethylene-co-vinylacetate), ethylene acrylic copolymers, amorphous polypropylene, copolymers, graft copolymers, and block copolymers of propylene; cellulosic polymers, such as cellulose acetate or cellulose butyrate, and the like; polyimides, and the like.

The colorants include dyes and pigments. Preferably, they are either soluble or colloidally dispersible in the thermoplastic polymer. Suitable colorants can vary widely in composition and type, but can be selected from among the known colorants; see, for example, the dyes and pigments disclosed in U.S. Pat. No. Re.31,072. The pigments used preferably have particle sizes below about 1 micron.

Suitable charge control agents can be selected from among those taught in the prior art; see, for example, the teachings of U.S. Pat. Nos. 3,893,935; 4,496,643; 4,789,614; and 4,837,391, and British Patent Nos. 1,501,065 and 1,420,839.

For purposes of toner powder preparation, the fluorinated onium salts of Formula II can be processed by known procedures. Typically, a compound of Formula II is introduced into the polymer matrix of a particular toner powder; however, a compound of Formula II can be merely admixed with a preformed batch of toner particles, if desired. Compounds of Formula II are typically solids, and if so admixed the particle size thereof is preferably below about 1 micron. One convenient technique for incorporating a compound of Formula II into the polymer matrix of a toner particle is to dissolve the Formula II compound and the polymer in a common organic solvent liquid. The colorant can be concurrently dissolved or dispersed in the organic liquid. Thereafter, the solvent can be removed by spray drying while the solid toner particles are formed. Mixtures of Formula II compounds can be employed, if desired.

A presently preferred method for toner powder preparation comprises the steps of:

a) melt compounding or extruding a mixture of the thermoplastic polymer, a colorant, a compound of Formula II, and optionally other additives such as an additional charge control agent;

b) coarse grinding this mixture;

c) fine grinding the coarse grind; and d) optionally classifying the fine grind.

Toner powders of this invention can employ compounds of Formula II either as the sole charge control agent or in combination with another charge control agent. When used as the sole charge control agent, the compound of Formula II is preferably incorporated into the particle matrix polymer and the amount employed is preferably in the range of about 0.05 to about 6 weight percent of the total toner powder composition. When used in combination with another charge control agent, the compound of Formula II is likewise preferably incorporated into the particle matrix polymer, but the amount of Formula II compound and the amount of other charge control agent employed is typically and preferably in the range of about 0.05 to about 6 weight percent of the total toner powder composition.

Combinations of certain Formula II compounds with certain known charge control agents can produce enhanced triboelectric effects compared to the use of Formula II compounds alone or other charge control agents alone.

Preferred other charge control agents are those disclosed in U.S. Pat. Nos. 4,496,643; 4,684,596; 4,789,614; 4,803,017; 4,806,283; 4,806,284; 4,812,378; 4,812,380; 4,812,381; 4,812,382; 4,834,920; 4,834,921; 4,837,391; 4,840,864; and 4,851,561.

When the onium salts of the present invention are applied to the element from which a toner image is transferred, conventional toner composition are utilized. These compositions comprise:

from about 1 to about 25 weight percent colorant;

from about 0.05 to about 6 weight percent charge control agent; and from about 69 to about 98.95 weight percent thermoplastic polymer.

When a toner composition contains the onium salts of the present invention, it comprises:

from about 1 to about 25 weight percent colorant;

from about 0.025 to about 6 weight percent prior art charge control agent;

from about 0.025 to about 6 weight percent Formula II compound; and from about 69 to about 98.95 weight percent thermoplastic polymer.

Instead of, or in addition to, being incorporated into toner particles, the surface of the element to be used for imaging, development, and toned image transfer to the receiver sheet can be coated with at least one compound of Formula II. Suitable coating thicknesses can range widely, but a presently preferred thickness is in the range of about 30 Å to about 1 micron. Preferably the coating is continuous.

The coating can be applied by any convenient technique. Presently preferred methods are rubbing and solvent coating.

When solvent coating is utilized, it is preferred to dissolve or colloidally disperse the Formula II compound in an organic solvent or water. Examples of suitable organic solvents include, for example, chloromethane, dichloromethane, trichloromethane, carbon tetrachloride, 1,2-dichloroethylene, vinyl chloride, 2-nitropropane, toluene, xylene, cyclohexanol, ethyl acetate, methyl ethyl ketone, methyl ethyl ether, and the like. The total weight of Formula II compound in such a solution is conveniently in the range of about 0.1 to about 10 weight percent with the balance up to 100 weight percent being solvent.

The compounds of Formula II can also be used to coat an intermediate transfer roller for subsequent transfer to the final receiver sheet.

The present invention also provides a process for achieving improved transfer properties in electrostatic imaging, including improved electrostatic transfer efficiency and improved triboelectric behavior. Either the toner particles used for imaging contain incorporated therewith at least one compound of Formula II, or the surface of the element is coated with at least one compound of Formula II, or both.

In the process of the present invention, toner powder is transferred electrostatically from the surface of an element to the surface of a receiver sheet in the presence of at least one compound of Formula II. The toner powder so transferred preferably comprises a developed toned image that has been produced by toning a latent image formed on such element in the conventional manner, as for example by the procedure disclosed in U.S. Pat. No. 4,851,561.

The Formula II compound is either coated on the surface of the element or is incorporated with the toner powder, as taught herein.

The invention is further illustrated by the following examples in which the terms "trifluoromethanesulfonate" and "triflate" and the structural notations "$\ominus OSO_2CF_3$" and "$\ominus$OTf" are synonymous. Also, the terms "p-toluenesulfonate" and "tosylate", and the structural notation

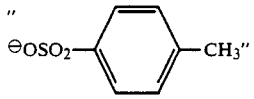

and $\ominus$OTs" are synonymous. Further, the structural notation "$\phi$" and

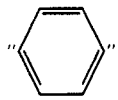

are synonymous and used interchangeably.

EXAMPLE 1

N,N-Dimethyl-2,2,3,3,4,4,5,5,6,6,7,7,8,8,8-pentadecafluorooctanamide

The reaction was carried out in a 250 mL, 3-necked, round bottom flask, equipped with a magnetic stirrer, dry ice condenser, addition funnel, and gas inlet tube. The flask was charged with 50 mL toluene (dried over 3A sieves) and cooled in an ice-water bath. Dimethylamine (18.5 g, 411 mmol) was condensed into the flask, and 46.9 g (137 mmol) perfluorooctanoyl chloride was added over 2.5 hr. via the addition funnel. The reaction was allowed to stir at room temperature overnight, and was then quenched with water. The layers were separated, and the aqueous phase was extracted twice with ether. The combined organic layers were washed with sat. aq. NaCl, then further dried over sodium carbonate. The volatiles were evaporated, and the residue was distilled: bp 45°-50° C. (0.4 torr).

Yield: 30.6 g (69.4 mmol, 50.7%).

Analyses: $^1$H NMR ($CDCl_3$): $\delta$ 3.07 (s), and 3.18 ppm (t, J=2 Hz); IR (neat); $\nu$ 1692, 1408, 1238, 1210, 1144, and 1011 cm$^{-1}$; EIMS: m/e 441 amu (M+); anal, calcd. for $C_{10}H_6F_{15}NO$ (441.134): 3.3% N, 27.3% C, and 1.7% H; found: 3.2% N, 27.2% C, and 1.4% H.

EXAMPLE 2

Dimethyl-(2,2,3,3,4,4,5,5,6,6,7,7,8,8,8-pentadecafluorooctyl)amine

The reaction was carried out under dry nitrogen in a 250 mL, 3-necked, round bottom flask, equipped with a magnetic stirrer, a reflux condenser, and an addition funnel. To a suspension of 1.17 g (30.8 mmol) lithium aluminum hydride in dry diethyl ether (20 mL; distilled from sodium) was added a slurry of 4.5 g (34 mmol) aluminum trichloride in dry ether (50 mL over 10 min, causing a gentle reflux. The reaction was then heated to reflux for an additional 30 min. It was cooled and then quenched by the cautious addition of water (8 mL), followed by 6 N sulfuric acid (20 mL). The thick slurry was filtered through a pad of diatomaceous earth, then transferred to a separatory funnel. The layers were separated, and the aqueous phase was extracted with ether (2×50 mL). The combined ether layers were dried (sodium sulfate), then evaporated, yielding 6.76 g (15.8 mmol, 53%) of a colorless, volatile liquid. $^1$H NMR ($CDCl_3$) shows a singlet (6 H) at 2.43 ppm, and a doublet (2 H, J=16 Hz) at 2.98 ppm relative to TMS, consistent with the expected product. There were no obvious impurities present in the NMR spectrum.

EXAMPLE 3

4-(1-Oxo-2,2,3,3,4,4,4-heptafluorobutyl)-N,N-dimethylaniline

A mixture of 7.0 g (52 mmol) aluminum trichloride and 11.2 g (48.2 mmol) heptafluorobutyryl chloride in 100 mL dichloromethane (dried over 3A sieves) was stirred for 30 min. at room temperature. To this mixture was added 6.23 g (51.4 mmol) N,N-dimethylaniline (distilled from calcium hydride) via addition funnel over 20 min. The dark green reaction mixture was refluxed for 18 hr, and then it was poured into 250 mL 1N HCl. The aqueous phase was extracted with ether (1×400 mL, 3×100 mL). The combined extracts were dried over sodium sulfate. Evaporation of the ether yielded 5.87 g of a brown liquid. This was chromatographed on silica gel, eluting with cyclohexane. The yellow band was collected, and the solvent was evaporated, yielding 4.81 g of yellow oil. Analysis of this oil by $^1$H NMR revealed it to be a mixture of two products. The major component displays signals at 3.09 (singlet) and 7.28 ppm (aa'xx' quartet), while the minor component has signals at 3.34 (singlet) and 7.1–7.5 ppm (multiplet). Further analysis by combined gas chromatography-mass spectrometry (GC-MS) shows molecular ions at 317 (major) and 303 amu (minor component). In a separate experiment, the product was further purified to give a pure sample of the major component. Infrared spectroscopy (IR) shows prominent bands at 1670 (C=O stretch) and 1210 cm$^{-1}$ (broad, C—F stretches). Based on these observations, the major component was identified as 4-(1-oxo-2,2,3,3,4,4,4-heptafluorobutyl)-N,N-dimethylaniline, and the minor product was identified as N-methyl-N-phenyl-2,2,3,3,4,4,4-heptafluorobutanamide. The molar ratio of the two products was 84:16 by integration of the appropriate $^1$H NMR signals. This implies yields of 27% and 4.8%, respectively, based on heptafluorobutyryl chloride.

EXAMPLE 4

4-(2,2,3,3,4,4,4-Heptafluorobutyl)-N,N-dimethylaniline

The reaction was carried out on 4.80 g of a mixture of 4-(1-oxo-2,2,3,3,4,4,4-heptafluorogutyl)-N,N-dimethylaniline (84 mol %, 12.9 mmol) and N-methyl-N-phenyl-2,2,3,3,4,4,4-heptafluorobutanamide (16 mol %, 2.33 mmol) prepared as described above in Example 3. Under a dry nitrogen atmosphere, a suspension of 0.58 g (15 mmol) lithium aluminum hydride in anhydrous diethyl ether (20 mL) was added via addition funnel to a solution of 2.08 g (15.6 mmol) aluminum trichloride in ether (15 mL) over 15 min. After 5 min., a solution of the mixture described above was added over 15 min., causing the reaction to gently reflux. The reaction was heated to maintain a gentle reflux for an additional 30 min. and then cooled. Water (40 mL), followed by 6N sulfuric acid (10 mL) as added slowly, resulting in an exothermic reaction. The layers were separated, and the aqueous phase was extracted with ether (2×50 mL). The combined ether phases were dried ($Na_2SO_4$), filtered, and evaporated, giving 3.88 g of crude product. This was further purified by column chromatography on silica gel, eluting with cyclohexane. The first component (0.455 g) was identified by $^1$H NMR and IR as N-methyl-N-(2,2,3,3,4,4,4-heptafluorobutyl)aniline (67.6% yield). The second component was identified by $^1$H NMR and IR as 4-(2,2,3,3,4,4,4-heptafluorobutyl)-N,N-dimethylaniline (76.2% yield).

Analyses for the first component: $^1$H NMR ($CDCl_3$): δ 3.03 (s, 3H), 3.91 (t, 2H, J=16 Hz) and 6.6–7.5 ppm (m, 5H); IR (KBr): ν 1602, 1504, 1370, 1350, 1250-1150 (v. broad), 750, and 689 cm$^{-1}$.

Analyses the second component: $^1$H NMR ($CDCl_3$): δ 2.92 (s, 6H), 3.21 (t, 2H, J=19 Hz), and 6.86 ppm (aa'mm', 4H); IR (KBr): ν 1612, 1522, 1347, 1214, and 804 cm$^{-1}$.

EXAMPLE 5

4-(2,2,3,3,4,4,5,5,6,6,7,7,8,8,8-Pentadecafluorooctyl)-N,N-dimethylaniline

Using the same procedures as those employed in Examples 3 and 4, perfluorooctanoyl chloride was reacted with N,N-dimethylaniline, and the intermediate ketone was reduced. The crude product was purified by column chromatography on silica gel, eluting with ethyl acetate/cyclohexane. The first fraction was identified by $^1$H NMR, IR and MS as N-methyl-N-2,2,3,3,4,4,5,5,6,6,7,7,8,8,8pentadecafluorooctyl)aniline (2.0% overall yield based on perfluorooctanoyl chloride. The second fraction was identified by $^1$H NMR, IR, and MS as 4-(2,2,3,3,4,4,5,5,6,6,7,7,8,8,8-pentadecafluorooctyl)-N,N-dimethylaniline (20% overall yield). Analyses for the first fraction $^1$H NMR ($CDCl_3$): δ 3.04 (s, 3H), 3.93 (t, 2H, J=16 Hz), and 6.6–7.3 ppm (m, 5H); IR (KBr): ν 1601, 1500, 1365, 1200, 1145, 993, 772, 747, 690, and 659 cm$^{-1}$; FDMS: m/e 489 amu. Analyses for second fraction: $^1$H NMR ($CDCl_3$): δ 2.94 (s, 6H), 3.23 (t, 2H, J=19.5 Hz), and 6.87 ppm (aa'mm', 4H); IR (KBr): ν 1619, 1528, 1355, 1245, 1200, and 1164 cm$^{-1}$; FDMS: m/e 503 amu.

EXAMPLE 6

4-Perfluorohexyl-N,N-dimethylaniline

A mixture of 27.4 g (226 mmol) N,N-dimethylaniline, 24.9 g (55.8 mmol) perfluorohexyl iodide, and 3.76 g (59.2 mmol) copper powder (pretreated with saturated aqueous EDTA, then filtered, washed, and dried) in 180 mL dimethylsulfoxide was heated to 105°±5° C. for 16 hr. Upon cooling, the mixture separated, and the lower layer was removed and dissolved in dichloromethane (150 mL). This solution was washed with water (2×150 mL), dried with sodium sulfate, and evaporated on a rotary evaporator, resulting in 7.13 g of amber oil. This was further purified by column chromatography on silica gel, eluting with 0.5% ethyl acetate in cyclohexane. Two pure components were isolated, along with an intermediate fraction containing both components. The first component (0.90 g, 3.7%) was identified by $^1$H NMR, MS, and combustion analysis as 2-perfluorohexyl-N,N-dimethylaniline, and the second component (1.96 g, 8.0%) was identified by $^1$H NMR as 4-perfluorohexyl-N,N-dimethylaniline. Analyses for the first component:

$^1$H NMR ($CDCl_3$): δ 2.63 (s, 6H), and 7.1–7.7 ppm (m, 4H); FDMS: m/e 439 amu; Anal. calcd. for $C_{14}H_{10}F_{13}N$ (439.215): 3.2% N, 38.3% C, and 2.3% H; found: 3.0% N, 36.8% C, and 2.3% H. Analyses for the second component: $^1$H NMR ($CDCl_3$): δ 2.97 (s, 6H), and 7.02 ppm (aa'xx', 4H).

EXAMPLE 7

4-Perfluorooctyl-N,N-dimethylaniline

Using the same procedure as described in Example 6 for the preparation of 4-perfluorohexyl-N,N-dimethylaniline, a mixture of 24.8 g (45.4 mmol) perfluorooctyl iodide, 45.1 g (372 mmol) N,N-dimethylaniline, and 3.07 g (48.3 mmol) copper powder yielded, after 22 hr at 105°+/−5° C., 11.2 g of crude product which crystallized upon standing. The crude product was recrystallized from methanol (ca. 10 mL/g), yielding 5.18 g of colorless needles, identified by $^1$H NMR, IR and melting point as 4-perfluorooctyl-N,N-dimethylaniline. An additional amount of white crystalline material was observed in the upper layer of the cooled reaction mixture and was collected by filtration, resulting in 1.18 g of additional product, identical by $^1$H NMR and melting point to the previously isolated material. The supernatant from the recrystallization was concentrated and chromatographed as described in Example 6, resulting in two components. The first component (1.78 g, 7.3%) was identified by $^1$H NMR and MS as 2-perfluorooctyl- N,N-dimethylaniline, and the second component (0.62 g) was identified as additional 4-perfluorooctyl-N,N-dimethylaniline (total yield: 6.98 g, 28.5%). Analyses for 2-perfluorooctyl-N,N-dimethylaniline: $^1$H NMR ($CDCl_3$): δ 2.64 (s, 6H), and 7.0–7.7 ppm (m, 4H); FDMS: m/e 539 amu. Analyses for 4-perfluorooctyl-N,N-dimethylaniline: mp 70.3°–72.0° C.; $^1$H NMR ($CDCl_3$): δ 3.01 (s, 6H) and 7.00 ppm (aa'xx', 4H); IR (KBr): ν 1615, 1534, 1367, 1301, 1199, 1146, and 805 $cm^{-1}$.

EXAMPLE 8

Tris(4-trifluoromethyl)phenylphosphine

The reaction was carried out under dry argon in a 500 mL, 3-necked, round bottom flask equipped with a magnetic stirrer, two addition funnels, and a thermometer. The flask was charged with a solution of 18.7 g (83.1 mmol) 1-bromo-4-(trifluoromethyl)benzene in 100 mL anhydrous ether (distilled from lithium aluminum hydride). The flask was cooled to 0°–5° C. with an ice-water bath, and 37 mL (77.7 mmol) N-butyllithium (2.1M in hexane) was added at a rate such that the internal temperature was maintained at 0°–5° C. (0.5 hr.). The mixture was stirred an additional hour at 0°–5° C., then a solution of 3.62 g (26.4 mmol) phosphorous trichloride (distilled) in 40 mL anhydrous ether was added dropwise, again at a rate such that the temperature was maintained at 0°–5° C. for 1.5 hr. The mixture was stirred an additional 3 hr at this temperature, and was then carefully hydrolyzed with 100 mL 6N HCl. The ether layer was removed, and the aqueous phase was extracted with ether (50 mL). The combined ether layers were dried with sodium sulfate, and the solvent was removed on a rotary evaporator, yielding 15.4 g of crude product. This was purified by column chromatography, eluting with cyclohexane, yielding one major component which crystallized upon standing (11.0 g, 91.1%): $^1$H NMR ($CDCl_3$): δ 7.48 ppm (m); IR (KBr): ν 1604, 1393, 1315, 1130, 1052, 1010, 824, and 694 $cm^{-1}$.

EXAMPLE 9

Tris(3-trifluoromethyl)phenylphosphine

Using the same procedure as described above, tris(3-trifluoromethyl)phenylphosphine was prepared from 1-bromo-3-(trifluoromethyl)benzene in a yield of 79.8% after chromatography: $^1$H NMR ($CDCl_3$): δ 7.52 ppm (m); IR (neat): ν 1601, 1413, 1325, 1270, 1165, 1121, 1019, 797, 708, 698, and 694 $cm^{-1}$.

EXAMPLE 10

Hexyl trifluoromethanesulfonate

Under a dry nitrogen atmosphere, a solution of 18.1 g (177 mmol) 1-hexanol (dried over 3A sieves) and 14.1 g (178 mmol) pyridine (dried over 3A sieves) in 80 mL carbon tetrachloride (dried over 3A sieves) was added over 1.25 hr to a solution of 50 g (180 mmol) trifluoromethanesulfonic anhydride in 50 mL dry carbon tetrachloride, while cooling in an ice-water bath. After an additional 5 min, the mixture was filtered, and the solids were washed with cold carbon tetrachloride. The filtrate was evaporated, and the residue was distilled, giving 19.7 g (47.5%) of hexyl trifluoromethanesulfonate: bp 35°–36° C. (0.35–0.40 torr).

EXAMPLE 11

Butyl trifluoromethanesulfonate

Using the same procedure as described in Example 8, butyl trifluoromethanesulfonate was prepared from 1-butanol and trifluoromethanesulfonic anhydride: bp 48°–50° C. (14 torr).

EXAMPLE 12

3-(Trifluoromethyl)-N,N-dimethylaniline

A mixture of 27.3 g (169 mmol) trimethylphosphate was heated to 170°±5° C. for 2 hr. The mixture was cooled and then hydrolyzed with a solution of 25.5 g NaOH in 175 mL water. The resulting suspension was extracted with dichloromethane (2×200 mL, 1×100 mL), and the combined extracts were dried with sodium sulfate. The solvent was evaporated, yielding 23.6 g (74.3%) of 3-(trifluoromethyl)-N,N-dimethylaniline, identified by $^1$H NMR. The product was further purified by distillation, resulting in 20.4 g of light yellow liquid: bp 50°–60° C. (1.5–2.0 torr). Analyses: $^1$H NMR ($CDCl_3$): δ 2.93 (s, 6H) and 6.84, 7.24 ppm (m, 4H); IR (neat): ν 1613, 1590, 1510, 1441, 1365, 1320, 1302, 1230, 1189, 1162, 1120, 1070, 990, 960, 850, 780, 729, 694, and 652 $cm^{-1}$.

EXAMPLE 13

Other N,N-dimethylaniline derivatives

Several other N,N-dimethylaniline derivatives were prepared by the procedure described in Example 12. The results are summarized in Table 1 below.

TABLE 1

| R | YIELD | ANALYSES |
|---|---|---|
| 4-ethyl | 58% | NMR, IR |
| 4-dodecyl | 61% | IR |
| 4-tetradecyl | 70% | NMR, IR, MS, EA |

EXAMPLE 14

3-(Trifluoromethyl)-N,N,N-trimethylanilinium tosylate

A mixture of 8.21 g (43.4 mmol) 3-(trifluoromethyl)-N,N-dimethylaniline and 8.43 g (45.3 mmol) methyl p-toluenesulfonate (methyl tosylate) was mixed and heated to 80°±10° C. for 1.5 hr. The mixture was cooled and treated with ether, resulting in a suspension of fine powdery crystals. These were collected by filtration, washed with ether, and dried in a vacuum oven: 7.51 g (46.1%). The product was identified as 3-(trifluoromethyl)-N,N,N-trimethylanilinium tosylate by $^1$H NMR, IR, MS, and combustion analysis. Concentration of the filtrate yielded an additional 2.44 g (15.0%). The combined product was further purified by recrystallization from ethanol/toluene: mp 176.0°–178.2° C.; $^1$H NMR ($CDCl_3$): δ 2.31 (s, 3H), 3.90 (s, 9H), 7.33 (aa'mm', 4H), 7.59 (m 2H), 7.95 (m, 1H), and 8.40 ppm (m, 2H); IR (KBr): ν 1322, 1199, 1127, 812, and 689 $cm^{-1}$; FDMS: m/e 204 amu ($R_4N+$); anal. calcd. for $C_{17}H_{20}F_3NO_3$ (375.41): 3.7% N, 54.4% C, 5.4% H, and 15.2% F; found: 4.2, 4.6% N, 54.3, 54.4% C, 5.4, 5.7% H, and 15.3% F.

EXAMPLE 15

3-(Trifluoromethyl)-N,N,N-trimethylanilinium trifluoromethanesulfonate

To a solution of 4.79 g (25.3 mmol) 3-(trifluoromethyl)-N,N-dimethylaniline in 50 mL anhydrous ether was slowly added 3.0 mL (26 mmol) methyl trifluoromethanesulfonate via syringe. The mixture was stirred 26 hr at room temperature, and the white precipitate was filtered, washed with ether, and dried in a vacuum oven: 8.35 g (93.4%). The product was further purified by recrystallization from acetonitrile/toluene, and was identified as 3-(trifluoromethyl)-N,N,N-trimethylanilinium trifluoromethanesulfonate by $^1H$ NMR, IR, MS, and combustion analysis: $^1H$ NMR ($D_2O$/DSS): δ 3.73 (s, 9H) and 7.6–8.3 ppm (m, 4H); IR (KBr): ν 1328, 1254, 1223, 1158, 1146, 1031, 808, and 689 $cm^{-1}$; FDMS: m/e 204 amu ($R_4N+$) anal. calcd. for $C_{11}H_{13}F_6NO_3S$ (353.281): 4.0% N, 37.4% C, 3.7% H, 32.3% F, and 9.1% S; found: 4.4% N, 37.8% C, 3.9% H, 31.4, 31.3% F, and 9.3% S.

EXAMPLE 16

(3-Trifluoromethylbenzyl)dimethyloctadecylammonium chloride

A solution of 36.1 g (121 mmol) dimethylocatadecylamine and 25.0 g (128 mmol) 3-(trifluoromethyl)benzyl chloride in 250 mL anhydrous acetonitrile (dried over 3A sieves) was refluxed for 15.5 hr. Upon cooling, a solid mass of crystals formed. These were collected on a medium sintered glass funnel, washed with anhydrous ether, then dried in a vacuum oven. The filtrate yielded a second crop of crystals, which were filtered, washed, and dried as above. Total yield: 54.6 g (111 mmol, 91.7%). A portion was further purified by recrystallization from acetone (ca. 10 mL/g): mp 174.5°–177.0° C.; $^1H$ NMR ($CDCl_3$): δ 0.87 (t, 3H), 1.27 (m, 28H), 1.79 (m, 2H), 3.38 (s, 6H), 3.52 (m, 2H), 5.36 (s, 2H), and 7.3–8.2 ppm (m, 4H); anal. calcd. for $C_{28}H_{49}NF_3Cl$ (492.154): 2.8% N, 68.3% C, 10.0% H, and 11.6% F; found: 3.0% N, 68.7% C, 3.0% H, and 11.5% F.

EXAMPLE 17

Other ammonium and phosphonium salts

Using the same procedures described in examples 14, 15, and 16, a number of other quaternary ammonium and phosphonium salts were prepared. The results are summarized in Table 2.

TABLE 2

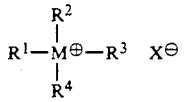

| M | $R^1$ | $R^2$ | $R^3$ | $R^4$ | X | Method* | Yield | Analyses NMR | IR | MS | EA |
|---|---|---|---|---|---|---|---|---|---|---|---|
| N | 4-$CH_3CH_2$ϕ- | $CH_3$ | $CH_3$ | $CH_3$ | OTs | A(100°/5Hr) | 97% | X | X | X | X |
| N | 4-$CH_3CH_2$ϕ- | $CH_3$ | $CH_3$ | $CH_3$ | OTf | A(70°/2.5Hr) | 93 | X | X | X | X |
| N | 4-$CH_3(CH_2)_{11}$ϕ- | $CH_3$ | $CH_3$ | $CH_3$ | OTs | A(70°/1.5hr) | 96 | X | X | X | X |
| N | 4-$CH_3(CH_2)_{11}$ϕ- | $CH_3$ | $CH_3$ | $CH_3$ | OTf | B(3hr) | 73 | X | X | X | X |
| N | 4-$CH_3(CH_2)_{13}$ϕ- | $CH_3$ | $CH_3$ | $CH_3$ | OTs | A(60°/1.5hr) | 68 | X | X | X | X |
| N | 4-$CH_3(CH_2)_{13}$ϕ- | $CH_3$ | $CH_3$ | $CH_3$ | OTf | B(1hr) | 91 | X | X | X | X |
| N | 4-$CF_3(CF_2)_2CH_2$ϕ- | $CH_3$ | $CH_3$ | $CH_3$ | OTs | A(100°/2hr) | 94 | X | X | X | X |
| N | 4-$CF_3(CF_2)_2CH_2$ϕ- | $CH_3$ | $CH_3$ | $CH_3$ | OTf | B(17hr) | 90 | X | X | X | X |
| N | 4-$CF_3(CF_2)_6CH_2$ϕ- | $CH_3$ | $CH_3$ | $CH_3$ | OTs | A(95°/2hr) | 93 | X | X | X | X |
| N | 4-$CF_3(CF_2)_6CH_2$ϕ- | $CH_3$ | $CH_3$ | $CH_3$ | OTf | B(21hr) | 97 | X | X | X | X |
| N | 3-$CF_3$ϕ- | $CH_3(CH_2)_3$— | $CH_3$ | $CH_3$ | OTf | A(90°/3hr) | 75 | X | X | X | X |
| N | 4-$CF_3(CF_2)_5$ϕ- | $CH_3$ | $CH_3$ | $CH_3$ | OTf | A(70°/3hr) | 70 | X | X | X | X |
| N | 4-$CF_3(CF_2)_5$ϕ- | $CH_3(CH_2)_5$— | $CH_3$ | $CH_3$ | OTf | A(80°/3hr) | 79 | X | X | X | X |
| N | 4-$CF_3(CF_2)_7$ϕ- | $CH_3$ | $CH_3$ | $CH_3$ | OTf | A(75°/2hr) | 95 | X | | X | X |
| N | 4-$CF_3(CF_2)_7$ϕ- | $CH_3(CH_2)_3$— | $CH_3$ | $CH_3$ | OTf | A(70°/3hr) | 91 | X | X | | X |
| N | 4-$CF_3(CF_2)_7$ϕ- | $CH_3(CH_2)_5$— | $CH_3$ | $CH_3$ | OTf | A(70°/3hr) | 90 | X | X | X | X |
| N | 4-$CF_3(CF_2)_6CH_2$ϕ- | $CH_3(CH_2)_5$— | $CH_3$ | $CH_3$ | OTf | B(50hr) | 8 | X | X | X | X |
| N | 4-$CF_3(CF_2)_7$ϕ- | H | $CH_3$ | $CH_3$ | OTf | B(74hr) | 86 | X | X | X | X |
| P | ϕ- | ϕ- | ϕ- | $CH_3$ | OTf | B(2.5hr) | 98 | X | X | | X |
| P | 4-$CF_3$ϕ- | 4-$CF_3$ϕ- | 4-$CF_3$ϕ- | $CH_3$ | OTs | A(135°/2hr) | 73 | X | X | X | X |
| P | 4-$CF_3$ϕ- | 4-$CF_3$ϕ- | 4-$CF_3$ϕ- | $CH_3$ | OTf | B(6hr) | 63 | X | X | X | X |
| P | 3-$CF_3$ϕ- | 3-$CF_3$ϕ- | 3-$CF_3$ϕ- | $CH_3$ | OTs | A(140°/3hr) | 88 | X | X | X | X |
| N | $(C_6F_5)CH_2$— | $CH_3(CH_2)_{17}$— | $CH_3$ | $CH_3$ | Br | C(0.5hr) | 84 | X | | | X |
| N | $CF_3(CF_2)_6CH_2$— | $CH_3$ | $CH_3$ | $CH_3$ | OTs | C(22hr) | 67 | X | X | | X |

*See examples 14 for A; 15 for B; 16 for C, methods

EXAMPLE 18

Benzyldimethyloctadecylammonium triflate

To a hot solution of 5.04 g (11.4 mmol) benzyldimethyloctadecylammonium chloride monohydrate in 75 mL water was added with rapid stirring solution of 1.95 g (12.5 mmol) lithium trifluoromethanesulfonate in 20 mL water, causing a very fine white precipitate to form. Methanol (ca. 50 mL) was added, resulting in some agglomeration of the precipitate. It was then filtered, washed with water, then sucked dry: 5.77 g (94.1%). The product was further purified by recrystallization from ethanol/toluene, resulting in 5.35 g of benzyldimethylocatadecylammonium trifluoromethanesulfonate, identified by $^1H$ NMR, IR, and combustion analysis: mp 112.8°–113.7° C.: $^1H$ NMR ($CD_3CN$): δ 0.88 (t, 3H), 1.5–2.2 (m, 35H), 2.94 (s, 6H), 3.1–3.4 (m, 2H), 4.39 (s 2H), and 7.51 ppm (s, 5H); IR (KBr): ν 1484, 1468, 1252, 1223, 1161, 1030, 787, 753, 732, 721, 706, and 638 $cm^{-1}$; anal. calcd. for $C_{28}H_{50}F_3NO_3S$ (537.768): 2.6% N, 62.5% C, 9.4% H, 10.6% F, and 6.0% S; found: 2.6% N, 63.0% C, 9.2% H, 10.8% F, and 5.9% S.

EXAMPLE 19

Preparation of other salts with fluorinated anions by ion-exchange

Several other quaternary ammonium and phosphonium salts were prepared by the method described in Example 18. The results are summarized in Table 3.

TABLE 3

(1)

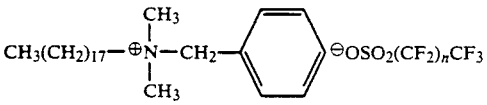

(2)

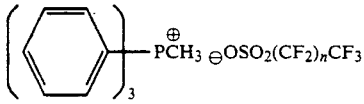

| Compd. | n | Yield | Analyses NMR | IR | EA |
|---|---|---|---|---|---|
| 1a | 0 | 94.1% | x | x | x |
| 1b | 3 | 75.7% | x | x | x |
| 1c | 7 | 74.9% | | | x |
| | | 79.6% | | | x |
| 2a* | 0 | | | | |
| 2b | 3 | 95.0% | | x | x |
| 2c | 7 | 92.7% | x | | x |

*Compd. 2a prepared as described in Example 15; see Table 2.

EXAMPLE 20

Halo Defects

A defect, of the "halo" type may be observed when a toned image is transferred from a film to a receiver which contains a previously transferred, or other raised image. The toner tends to not transfer around the periphery of the raised areas. It has been noted in the prior art that treatment of the photoconductor film surface with a lubricant such as zinc stearate eliminates this defect. In this Example, a photoconductive element was treated with several of the compounds of Formula II and the resultant transferred image quality was compared to controls in which the photoconductive element was either untreated or was treated with zinc stearate. A standard polyester magenta toner comprising methyltriphenylphosphonium tosylate charge control agent was utilized for all of the tests. In addition to halo defect, completeness of toner transfer was also noted, and the results of these tests were subjectively ranked using the following definitions:

| HALO | TRANSFER |
|---|---|
| 1 none (zinc stearate) | 0 complete |
| 2 minimal | 1 minimal residue |
| 3 slight | 2-3 slight residue |
| 4 improved | 4-7 improved |
| 5-6 normal (untreated film) | 8 normal |
| 7 worse | 9 worse |

The results of the actual tests are listed in Table 4 wherein it will be noted that several of the fluorinated charge agents of this invention provide improvements in both the halo defect and in the amount to transferred toner. In particular, the entry 1 compound in Table 4 appeared to completely eliminate the halo defect while leaving only a slight residue of untransferred toner.

TABLE 4

Halo Defect Evaluation

| Entry | Compound | Halo | Transfer |
|---|---|---|---|
| 1 | 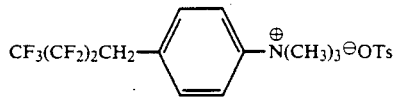 | 1 | 3 |
| 2 | 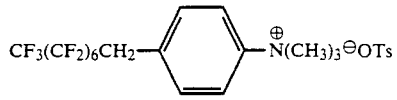 | 4 | 5 |
| 3 | 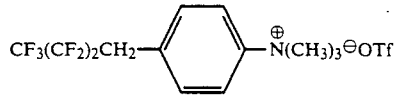 | 7 | 5 |
| 4 | 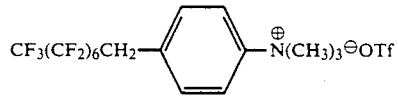 | 4 | 6 |
| 5 | 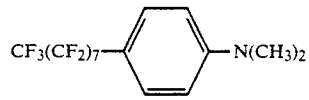 | 7 | 7 |
| 6 | 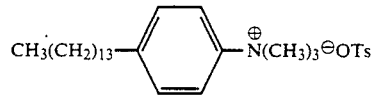 | 4-6 | 6 |
| 7 | 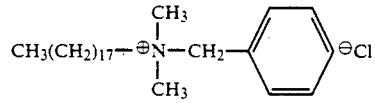 | 4 | 7 |

EXAMPLE 21

Hollow Character Defects

An image defect of the "hollow character" type may also be observed in transferred toner images. When this defect occurs, the edges of typographic characters transfer, while the centers do not. Treatment of the surface of a photoconductor film with a lubricant such as zinc stearate has also been known in the prior art as a means to eliminate this defect. In these tests, a standard black polyester toner comprising methyltriphenylphosphonium tosylate as the charge control agent was used, the surface of the photoconductive element was treated with several of the compounds of Formula II, and the completeness of transfer as well as the presence of hollow character were subjectively ranked using the following definitions:

| HOLLOW CHARACTER | TRANSFER |
|---|---|
| 1 none (zinc stearate) | 1 complete |
| 2 slight | 2 slight residue |
| 3 improved | 3 improved |
| 4 normal (untreated film) | 4 normal |
| 5 worse | 5 worse |

The results obtained are listed in Table 5 wherein it will be noted that all of the fluorinated charge-agents of this invention provide relief of the hollow character defect and exhibit improved transfer over the untreated film, as well as over the film treated with a non-fluorinated charge-agent (entry 7). It has thus been demonstrated that the fluorinated materials of the present invention offer an improvement in the transfer of toned images, and in particular they provide relief of the hollow character defect, when applied to the surface of the photoconductor.

TABLE 5

Hollow Character Defect Evaluation

| Entry | Compound | Character | Transfer |
|---|---|---|---|
| 1 | $CF_3(CF_2)_2CH_2$—(C6H4)—$\overset{\oplus}{N}(CH_3)_3\overset{\ominus}{O}Ts$ | 1 | 2 |
| 2 | $CF_3(CF_2)_6CH_2$—(C6H4)—$\overset{\oplus}{N}(CH_3)_3\overset{\ominus}{O}Ts$ | 1 | 2-3 |
| 3 | $CF_3(CF_2)_6CH_2$—(C6H4)—$\overset{\oplus}{N}(CH_3)_3\overset{\ominus}{O}Tf$ | 1 | 2-3 |
| 4 | $CF_3(CF_2)_7$—(C6H4)—$\overset{\oplus}{N}(CH_3)_2$—$(CH_2)_3CH_3\overset{\ominus}{O}Tf$ | 1 | 2-3 |
| 5 | $CF_3(CF_2)_7$—(C6H4)—$\overset{\oplus}{N}(CH_3)_2$—$(CH_2)_5CH_3\overset{\ominus}{O}Tf$ | 1 | 2-3 |

TABLE 5-continued

Hollow Character Defect Evaluation

| Entry | Compound | Character | Transfer |
|---|---|---|---|
| 6 | $CF_3$—(C6H4)—$\overset{\oplus}{N}(CH_3)_2$—$(CH_2)_3CH_3\overset{\ominus}{O}Tf$ | 1 | 3 |
| 7 | $CH_3(CH_2)_{17}$—$\overset{\oplus}{N}(CH_3)_3$ $\overset{\ominus}{O}Ts$ | 3 | 3 |
| 8 | $CH_3(CH_2)_{17}$—$\overset{\oplus}{N}(CH_3)_2$—$CH_2$—(C6H4)—$\overset{\ominus}{C}l$ | — | — |
| | | conductive | |

EXAMPLE 22

Triboelectric Behavior

This example was designed to illustrate the triboelectric behavior of styrenic toners comprising a fluorinated charge-control agent. Samples of toners comprising a styrenic binder, carbon black, and the charge agents and the concentrations listed in Tables 6 and 7 were prepared. The toners were charged against a ferrite carrier coated with 1 pph Kynar TM (a poly(vinylidene fluoride) resin) and the triboelectric characteristics of these materials are included in Tables 6 and 7 wherein it will be noted that the fluorinated charge agents of this invention exhibit desirable charge properties similar to those produced by the non-fluorinated control compounds.

TABLE 6

Charging Behavior of Fluorinated Charge-Agents in Black Styrenic (Toners Styrenic Polymer A)

| Entry | Compound | Level | 30 sec Charge | Throw-Off |
|---|---|---|---|---|
| 1 | $CH_3(CH_2)_{17}$—$\overset{\oplus}{N}(CH_3)_2$—$CH_2$—(C6H4)—$\overset{\ominus}{O}Tf$ | 1.0 pph | 35.7 μC/g | 2.5 mg |
| 2 | $CH_3(CH_2)_{17}$—$\overset{\oplus}{N}(CH_3)_2$—$CH_2$—(C6H4)—$\overset{\ominus}{O}SO_2(CF_2)_7CF_3$ | 1.0 | 20.5 | 4.5 |
| 3 | $CF_3(CF_2)_7$—(C6H4)—$\overset{\oplus}{N}(CH_3)_3\overset{\ominus}{O}Tf$ | 1.0 | 36.6 | 0.7 |
| 4 | $CF_3(CF_2)_2CH_2$—(C6H4)—$\overset{\oplus}{N}(CH_3)_3\overset{\ominus}{O}Ts$ | 1.0 | 13.0 | 7.4 |
| 5 | $CF_3(CF_2)_2CH_2$—(C6H4)—$\overset{\oplus}{N}(CH_3)_3\overset{\ominus}{O}Tf$ | 1.0 | 10.4 | 28 |

TABLE 6-continued

Charging Behavior of Fluorinated Charge-Agents in Black Styrenic (Toners Styrenic Polymer A)

| Entry | Compound | Level | 30 sec Charge | Throw-Off |
|---|---|---|---|---|
| 6 | 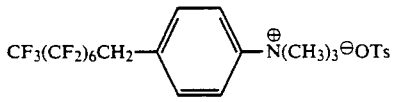 | 1.0 | 13.4 | 9.3 |
| 7 | 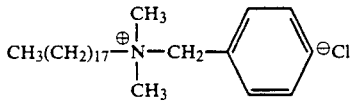 | 1.5 | 16.6 | 0.7 (control) |

TABLE 7

Charging Behavior of Fluorinated Charge-Agents in Black Styrenic Toners (Styrenic Polymer B)

| Entry | Compound | Level | 30 sec Charge | Throw-Off |
|---|---|---|---|---|
| 1 | 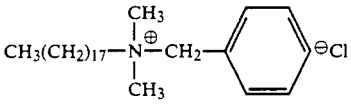 | 1.5 pph | 48.4 μC/g (Control) | 1.2 mg |
| 2 | 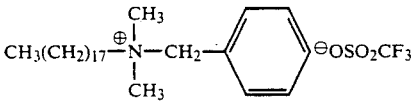 | 1.0 | 24.7 | 0.7 |
| 3 | 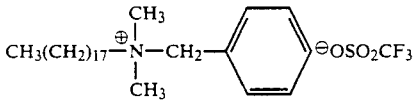 | 2.0 | 32.2 | 0.1 |
| 4 | 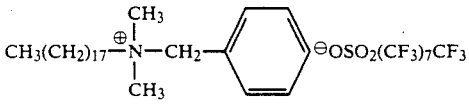 | 0.8 | 36.3 | 0.4 |
| 5 | 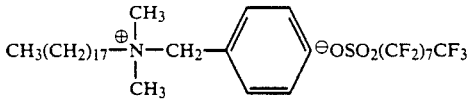 | 3.6 | 27 | 0.5 |
| 6 | 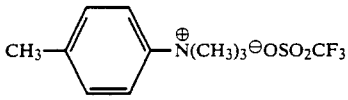 | 1.0 | 21.5 | 2.4 |
| 7 | 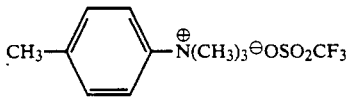 | 2.0 | 22.4 | 0.8 |

EXAMPLE 23

Triboelectric Behavior

This example was designed to illustrate the triboelectric behavior of polyester toners comprising a fluorinated charge-control agent. Samples of toners similar to those described in Example 22 above were prepared except that a polyester resin was used in place of the styrenic binder and no pigment was included. The toners were charged against a ferrite carrier coated with 1 pph Kynar TM. The charge agents, concentrations and triboelectric characteristics are summarized in Tables 8 and 9 wherein it will be noted that the fluorinated charge agents of this invention behave in a manner similar to the non-fluorinated control compounds.

TABLE 8
Charging Behavior of Fluorinated Charge-Agents in Unpigmented Polyester Toners against Carrier A at 13% T.C.
| Entry | Compound | Level | 30 sec Charge | Throw-Off |
|---|---|---|---|---|
| 1 | 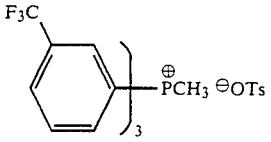 | 1.0 pph | 9.6μC/g | 1.5 mg |
| 2 | 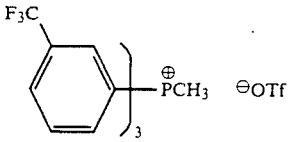 | 1.0 | 12.2 | 1.3 |
| 3 | 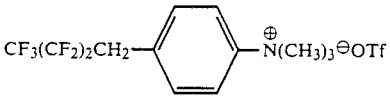 | 1.0 | 16.0 | 0.9 |
| 4 | 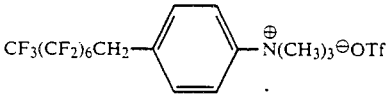 | 1.0 | 19.0 | 1.3 |
| 5 | 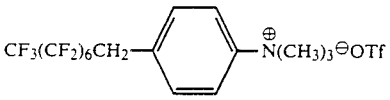 | 3.0 | 12.1 | 1.9 |
| 6 | 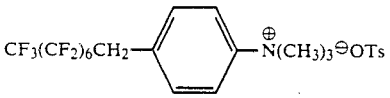 | 1.0 | 13.2 | 1.9 |
| 7 | 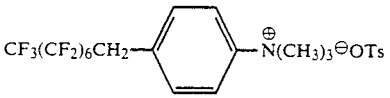 | 3.0 | 9.7 | 2.7 |
| 8 | 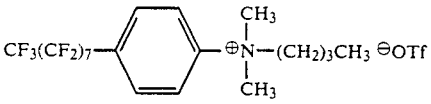 | 2.0 | 34.1 | 0.5 |
| 9 | 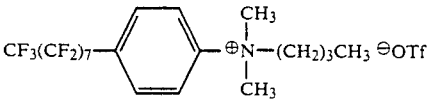 | 2.0 | 19.6 | 1.5 |
| 10 | 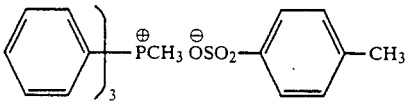 | 1.0 | 28.8 | 0.1 |
| 11 | 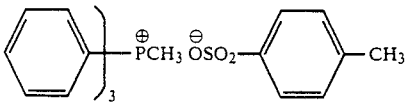 | 3.0 | 21.7 | (control) 1.0 |

TABLE 9

Charging Behavior of Charge-Agents with Fluorinated Anions in Unpigmented Polyester Toners against Carrier B at 13% T.C.

| Entry | Compound | Level | 30 sec Charge | Throw-Off |
|---|---|---|---|---|
| 1 | 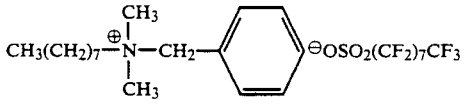 | 1.0 pph | 55.6 μC/g | 0.1 mg |
| 2 | | 3.0 | 38.0 | 0.4 |
| 3 | 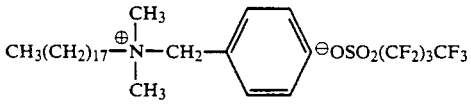 | 1.0 | 55.0 | 0.4 |
| 4 | " | 3.0 | 36.1 | 0.9 |
| 5 | 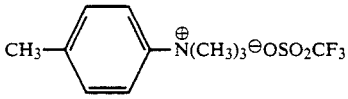 | 1.0 | 55.5 | 0.3 |
| 6 | " | 3.0 | 59.0 | 0.2 |
| 7 | 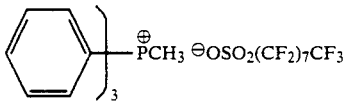 | 1.0 | 56.5 | 0.4 |
| 8 | " | 3.0 | 59.3 | 0.2 |
| 9 | 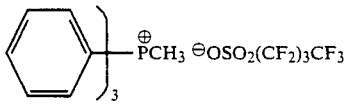 | 1.0 | 54.1 | 0.3 |
| 10 | " | 3.0 | 60.2 | 0.1 |
| 11 | 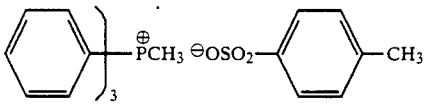 | 1.0 | 36.2 | 0.3 (control) |
| 12 | " | 3.0 | 50.3 | 0.8 |

The invention has been described in detail with particular reference to preferred embodiments thereof, but it will be understood that variations and modifications can be effected within the spirit and scope of the invention.

We claim:

1. In a process for increasing the electrostatic transfer efficiency of toner powder from the surface of an element to the surface of a receiver sheet, the improvement which comprises carrying out said transfer in the presence of at least one fluorinated onium salt that is on the surface of the element or incorporated in the toner powder, said fluorinated onium salt having the formula:

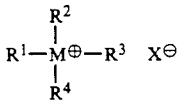

wherein:

M is selected from the group consisting of nitrogen and phosphorous; $R^1$, $R^2$, $R^3$; and $R^4$ are each selected from the group consisting of hydrogen, alkyl of 1 through 30 carbon atoms, cycloalkyl of 3 through 30 carbon atoms, fluorinated and perfluorinated alkyl of 1 through 30 carbon atoms, fluorinated and perfluorinated cycloalkyl of 3 through 30 carbon atoms, aryl of 6 through 18 carbon atoms, and alkaryl of the formula:

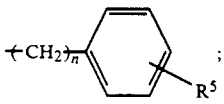

$R^5$ is selected from the group consisting of hydrogen, alkyl of 1 through 30 carbon atoms, cycloalkyl of 3 through 30 carbon atoms, fluorinated and perfluorinated alkyl of 1 through 30 carbon atoms, and partially fluorinated and perfluorinated cycloalkyl of 3 through 30 carbon atoms;

X is a monovalent anion selected from the group consisting of halide; carboxylate of the formula:

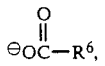

phosphate, borate, sulfate, and sulfonates of the formula:

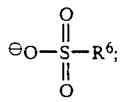

$R^6$ is selected from the group consisting of alkyl of 1 through 30 carbon atoms, cycloalkyl, cycloalkyl of 3 through 30 carbon atoms, fluorinated and perfluorinated alkyl of 1 through 30 carbon atoms, and fluorinated and perfluorinated cycloalkyl of 3 through 30 carbon atoms; and n is an integer of 0, 1, or 2;

wherein two or more of $R^1$ and $R^6$ can be interconnected together to form cyclic groups and/or inner salts; provided that at least one of $R^1$ through $R^6$ is selected from the group consisting of partially fluorinated and perfluorinated alkyl of 1 through 30 carbon atoms and partially fluorinated and perfluorinated cycloalkyl of 3 through 30 carbon atoms.

2. The process of claim 1 wherein said fluorinated onium salt is preliminarily coated on said surface of said element.

3. The process of claim 2 wherein said coating has a thickness in the range of about 30 Å to about 1 micron.

4. The process of claim 1 wherein M is nitrogen or phosphorous; $R^1$ is methyl; $R_2$ is methyl or

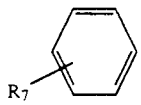

where $R^7$ is $CF_3$; $R^3$ is methyl, butyl, hexyl or

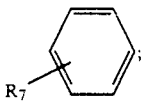

$R^4$ is

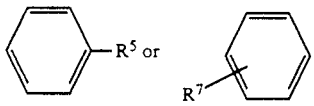

and X is

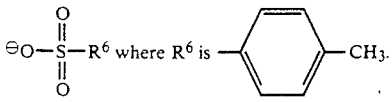

5. The process of claim 1 wherein said fluorinated onium salt is incorporated in said toner powder.

6. The process of claim 5 wherein said toner powder additionally contains incorporated therewith a charge control agent.

7. Toner powder having a particle size in the range from about 3 to about 100 microns comprising in combination on a 100 weight percent total basis:

about 0.05 to about 6 weight percent of at least one fluorinated onium salt of the formula:

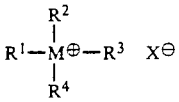

wherein:

M is selected from the group consisting of nitrogen and phosphorous; $R^1$, $R^2$, $R^3$, and $R^4$ are each selected from the group consisting of hydrogen, alkyl of 1 through 30 carbon atoms, cycloalkyl of 3 through 30 carbon atoms, fluorinated and perfluorinated alkyl of 1 through 30 carbon atoms, fluorinated and perfluorinated cycloalkyl of 3 through 30 carbon atoms, aryl of 6 through 18 carbon atoms, and alkaryl of the formula:

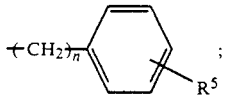

$R^5$ is selected from the group consisting of hydrogen, alkyl of 1 through 30 carbon atoms, cycloalkyl of 3 through 30 carbon atoms, fluorinated and perfluorinated alkyl of 1 through 30 carbon atoms, and partially fluorinated and perfluorinated cycloalkyl of 3 through 30 carbon atoms;

X is a monovalent anion selected from the group consisting of halide; carboxylate of the formula:

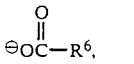

phosphate, borate, sulfate, and sulfonate of the formula:

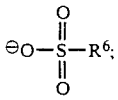

$R^6$ is selected from the group consisting of alkyl of 1 through 30 carbon atoms, cycloalkyl, cycloalkyl of 3 through 30 carbon atoms, fluorinated and perfluorinated alkyl of 1 through 30 carbon atoms, and fluorinated and perfluorinated cycloalkyl of 3 through 30 carbon atoms;

n is an integer of 0, 1, and 2;

wherein two or more of $R^1$ through $R^6$ can be interconnected together to form cyclic groups and/or inner salts; provided that at least one of $R^1$ through $R^6$ is selected from the group consisting of fluorinated and perfluorinated alkyl of 1 through 30 carbon atoms and fluorinated and perfluorinated cycloalkyl of 3 through 30 carbon atoms;

from about 1 to about 25 weight percent of colorant; and from about 69 to about 98.95 weight percent of thermoplastic polymer.

8. A photoconductor whose imageable surface is coated with a coating comprised of at least one onium compound of the formula:

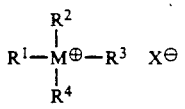

wherein:

M is selected from the group consisting of nitrogen and phosphorous; $R^1$, $R^2$, $R^3$, and $R^4$ are each selected from the group consisting of hydrogen, alkyl of 1 through 30 carbon atoms, cycloalkyl of 3 through 30 carbon atoms, fluorinated and perfluorinated alkyl of 1 through 30 carbon atoms, fluorinated and perfluorinated cycloalkyl of 3 through 30 carbon atoms, aryl of 6 through 18 carbon atoms, and alkaryl of the formula:

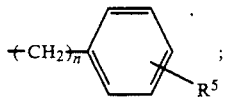

$R^5$ is selected from the group consisting of hydrogen, alkyl of 1 through 30 carbon atoms, cycloalkyl of 3 through 30 carbon atoms, fluorinated and perfluorinated alkyl of 1 through 30 carbon atoms, and fluorinated and perfluorinated cycloalkyl of 3 through 30 carbon atoms;

X is a monovalent anion selected from the group consisting of halide; carboxylate of the formula:

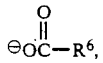

phosphate, borate, sulfate, and sulfonate of the formula:

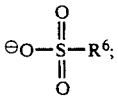

$R^6$ is selected from the group consisting of alkyl of 1 through 30 carbon atoms, cycloalkyl, cycloalkyl of 3 through 30 carbon atoms, fluorinated and perfluorinated alkyl of 1 through 30 carbon atoms, and fluorinated and perfluorinated cycloalkyl of 3 through 30 carbon atoms;

n is an integer of 0, 1, or 2;

wherein two or more of $R^1$ through $R^6$ can be interconnected together to form cyclic groups and/or inner salts; provided that at least one of $R^1$ through $R^6$ is selected from the group consisting of fluorinated and perfluorinated alkyl of 1 through 30 carbon atoms and fluorinated and perfluorinated cycloalkyl of 3 through 30 carbon atoms.

9. The photoconductor of claim 8 wherein said coating has a thickness in the range of about 30 Å to about 1 micron.

10. The process of claim 7 wherein M is nitrogen or phosphorous; $R^1$ is methyl; $R_2$ is methyl or

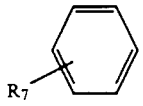

wherein $R^7$ is $CF_3$; $R^3$ is methyl, butyl, hexyl or

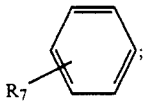

$R^4$ is

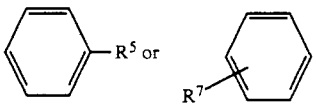

and X is

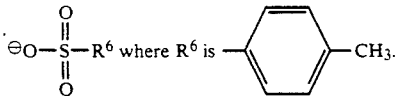

11. The process of claim 8 wherein M is nitrogen or phosphorous; $R^1$ is methyl; $R_2$ is methyl or

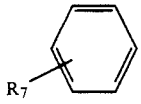

where $R^7$ is $CF_3$; $R^3$ is methyl, butyl, hexyl or

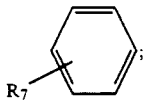

$R^4$ is

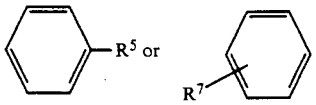

and X is

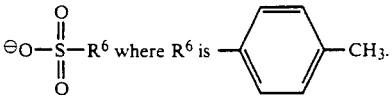

* * * * *

UNITED STATES PATENT AND TRADEMARK OFFICE

CERTIFICATE OF CORRECTION

PATENT NO. : 5,051,330

DATED : September 24, 1991

INVENTOR(S) : Alexandrovich et al.

It is certified that error appears in the above-identified patent and that said Letters Patent is hereby corrected as shown below:

Column 4, line 51 "herein" should be --therein--

Column 11, line 27 "heptafluorogutyl" should be --heptafluorobutyl--.

Signed and Sealed this

Twenty-third Day of February, 1993

*Attest:*

STEPHEN G. KUNIN

*Attesting Officer*

*Acting Commissioner of Patents and Trademarks*